US010546453B2

(12) United States Patent
Inamura

(10) Patent No.: US 10,546,453 B2
(45) Date of Patent: Jan. 28, 2020

(54) GAMING SYSTEM AND METHOD FOR PROVIDING A WILD REEL

(71) Applicant: ARUZE GAMING HONG KONG Limited, Central Hong Kong (HK)

(72) Inventor: Yukinori Inamura, Tokyo (JP)

(73) Assignee: Aruze Gaming (Hong Kong) Limited, Hong Kong (HK)

( * ) Notice: Subject to any disclaimer, the term of this patent is extended or adjusted under 35 U.S.C. 154(b) by 0 days.

(21) Appl. No.: 15/976,747

(22) Filed: May 10, 2018

(65) Prior Publication Data

US 2018/0357853 A1 Dec. 13, 2018

Related U.S. Application Data

(60) Provisional application No. 62/504,940, filed on May 11, 2017.

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
CPC ..... G07F 17/3213; G07F 17/34
USPC ..... 463/20
See application file for complete search history.

(56) References Cited

U.S. PATENT DOCUMENTS

| | | | | |
|---|---|---|---|---|
| 6,190,254 | B1 | 2/2001 | Bennett | |
| 7,749,071 | B2 * | 7/2010 | Marks | G07F 17/3265 463/20 |
| 8,137,179 | B2 * | 3/2012 | Jensen | G07F 17/32 463/16 |
| 8,814,656 | B2 | 8/2014 | Caputo | |
| 8,840,457 | B1 * | 9/2014 | Basallo | G07F 17/34 463/20 |
| 2006/0058097 | A1 | 3/2006 | Berman et al. | |
| 2008/0108411 | A1 | 5/2008 | Jensen et al. | |
| 2008/0214292 | A1 | 9/2008 | Bryant et al. | |
| 2010/0190543 | A1 | 7/2010 | Englman et al. | |
| 2012/0034967 | A1 | 2/2012 | Owen et al. | |
| 2014/0323198 | A1 | 10/2014 | Tuck | |
| 2015/0018071 | A1 | 1/2015 | Elias et al. | |

* cited by examiner

*Primary Examiner* — Allen Chan
(74) *Attorney, Agent, or Firm* — EIP US LLP

(57) ABSTRACT

A system apparatus and method which provides a player of a gaming system the ability to increase their wager for a guaranteed wild reel. The system apparatus and method may increase the number of reels that may become a wild reel based on the player increasing their wager. A system apparatus and method which provides a player of a non-wagering or social gaming system the ability to increase their virtual wager for a guaranteed wild reel is also contemplated.

20 Claims, 15 Drawing Sheets

GAMING SYSTEM AND METHOD FOR PROVIDING A WILD REEL

CROSS-REFERENCE TO RELATED APPLICATIONS

This application claims the benefit of U.S. Provisional Application No. 62/504,940, filed May 11, 2017. The above-referenced patent application is incorporated by reference in its entirety.

BACKGROUND OF THE INVENTION

Field of the Invention

The present disclosure relates to gaming systems, such as gaming machines and slot machines.

Description of the Related Technology

Gaming machines, such as slot machines, video poker machines, and other mechanical, electromechanical, and electronic machines used to determine and/or display wagering game outcomes have become an integral part of the worldwide gambling industry. Often, the commercial success of such gaming machines is heavily reliant on their methods of determining the gaming outcomes, and their methods of displaying the gaming outcomes. These methods must be statistically reliable, but typically must also be easily understood by a player, and entertaining, in order to prove successful.

More recently, the games historically found on gaming machines have been employed away from the casino in non-gambling environments, such as on-line and mobile representations, where no money is wagered, but instead non-redeemable credits are used to play such games. These non-redeemable credits are sometimes provided to a player for free, but in some instances, must be purchased by a player in order to be utilized to play a game. In such formats, as money is not being wagered, the games typically do not have to prove statistically reliable. However, it is strongly believed that the commercial success of such implementations is still reliant on their ease of understanding, and their entertainment value.

Players of such gaming systems often fluctuate their wagers, in hopes of receiving higher awards based on their higher wagers. However, often times such players are not made aware whether their higher wagers affect their chances for better outcomes, as this information is not easily conveyed.

SUMMARY

In one embodiment of the present disclosure, a gaming system provides at least one processor, and least one player input device, at least one memory device, and at least one display device, wherein a player of the gaming system is allowed to make one of a plurality of different qualifying wagers, and based on the player making one of the qualifying wagers, the gaming system determines a subset of reels displayed by the display device to highlight as being eligible for being a WILD reel. In this embodiment, the gaming system then selects one of the highlighted reels to be a WILD reel, and then determines a game outcome based on the WILD reel and the other reels.

In another embodiment, a method for operating a gaming system comprises validating a receiving of a physical indicia of monetary value, receiving an electronic communication to begin a new wagering game, and determining a wager associated with the new wagering game. The associated wager can be correlating to one of a plurality of different qualifying wager level. A display device can display a plurality of reels, and a number of the displayed plurality of reels can be highlighted based on the correlated qualifying wager level. Each of a plurality of the different qualifying wager levels can cause a different number of the displayed plurality of reels to be highlighted. The display device can display the spinning of the plurality of reels, and when the number of highlighted reels is equal to one, the highlighted reel can be determined to be a wild reel. When the number of highlighted reels is equal to two, a determination of which of the two highlighted reels is a wild reel can be based on a probability associated with each of the two highlighted reels, and the probability associated with each of the two highlighted reels can be different. When the number of highlighted reels is greater than two, a determination of which of the greater than two highlighted reels is a wild reel can be based on a probability associated with each of the greater than two highlighted reels, and the probability associated with a plurality of the greater than two highlighted reels can be different. The display device can display any determined wild reel to stop and indicate that the entire reel is wild. Each of the reels not determined to be a wild reel can stop and the outcome of the game can be determined based on the stopped reels. When the determined outcome is a winning outcome, an award can be provided to the player based at least in part on the determined outcome and the determined wager.

In another embodiment, a gaming system can include at least one display device, at least one processor, and at least one memory device storing a plurality of instructions, which when executed by the at least one processor. The processor can validate a receiving of a physical indicia of monetary value and can receive an electronic communication to begin a new wagering game. The processor can determine a wager associated with the new wagering game and can correlate the associated wager to one of a plurality of different qualifying wager levels. The processor can cause the at least one display device to display a plurality of reels and can cause a number of the displayed plurality of reels to be highlighted based on the correlated qualifying wager level. Each of a plurality of the different qualifying wager levels can cause a different number of the displayed plurality of reels to be highlighted. The processor can cause the at least one display device to display the spinning of the plurality of reels. When the number of highlighted reels is equal to one, the processor can determine that the highlighted reel is a wild reel. When the number of highlighted reels is equal to two, the processor can determine, based on a probability associated with each of the two highlighted reels, which of the two highlighted reels is a wild reel, and the probability associated with each of the two highlighted reels can be different. When the number of highlighted reels is greater than two, the processor can determine, based on a probability associated with each of the greater than two highlighted reels, which of the greater than two highlighted reels is a wild reel, and the probability associated with a plurality of the greater than two highlighted reels can be different. The processor can cause the at least one display device to display any determined wild reel to stop and indicate that the entire reel is wild. The processor can cause each of the reels not determined to be a wild reel to stop and can determine the outcome of the game based on the stopped reels. When the determined outcome is a winning outcome, the processor can provide an award to the player based at least in part on the determined outcome and the determined wager.

In another embodiment, a method for operating a gaming system comprises the receiving of an electronic communication to begin a new wagering game, the determining of a wager associated with the new wagering game, then the determining of whether the associated wager is one of a plurality of qualifying wagers. When it is determined that the associated wager is one of the plurality of qualifying wagers, the method then determines the level of the qualifying wager, and determines a number of displayed reels to highlight based on the determined level of the qualifying wager, wherein the number of displayed reels to highlight is greater than one and less than five. Next, the method causes a display device to display the spinning of the five reels, and when the number of highlighted reels is equal to one, determines that the highlighted reel is a wild reel, but when the number of highlighted reels is equal to two, determines, based on a probability associated with each of the two highlighted reels, which of the two highlighted reels is a wild reel, wherein the probability associated with each of the two highlighted reels is different. But when the number of highlighted reels is equal to three, the method determines, based on a probability associated with each of the three highlighted reels, which of the three highlighted reels is a wild reel, wherein the probability associated with each of the three highlighted reels is different, but then when the number of highlighted reels is equal to four, determines, based on a probability associated with each of the four highlighted reels, which of the four highlighted reels is a wild reel, wherein the probability associated with each of the four highlighted reels is different. Afterward, the method causes the display device to display any determined wild reel to stop and indicate that the entire reel is wild, and thereafter, cause each of the reels not determined to be a wild reel to stop, then determines the outcome of the game based on the stopped reels, and when the determined outcome is a winning outcome, provides an award to the player based at least in part on the determined outcome and the determined wager.

It is therefore an advantage of the present disclosure to provide the player an opportunity for a guaranteed WILD reel.

It is another advantage of the present disclosure to provide the player an opportunity to obtain a WILD reel in a better position by increasing their wager.

It should be understood that various changes and modifications to the disclosed embodiments described herein will be apparent to those skilled in the art. Such changes and modifications can be made without departing from the spirit and scope of the present subject matter and without diminishing its intended advantages.

DETAILED DESCRIPTION OF CERTAIN INVENTIVE EMBODIMENTS

Figure 1:
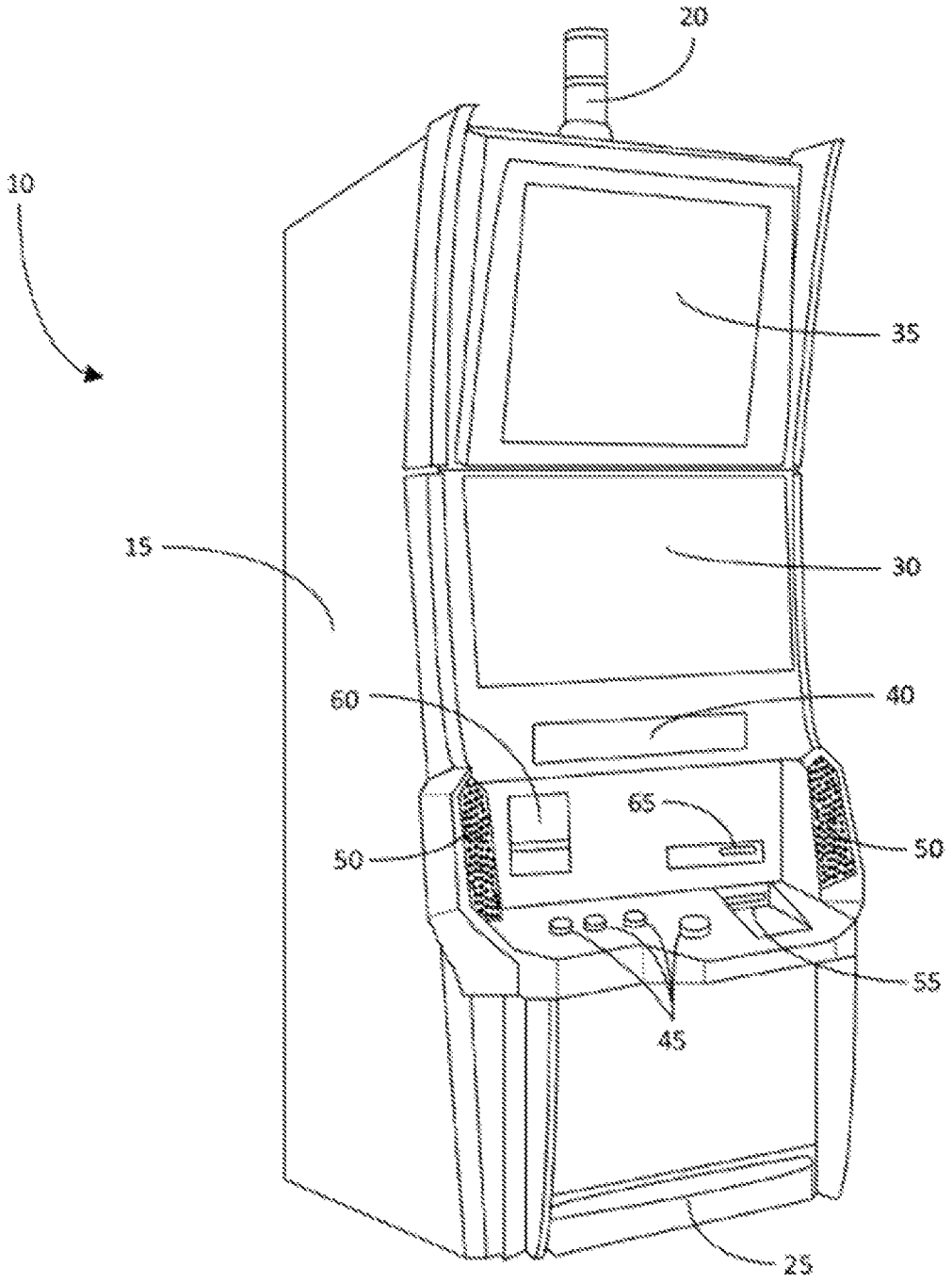
FIG. 1 is a perspective view of a gaming machine, in accordance with an embodiment of the present disclosure.

Referring to FIG. 1, a typical gaming machine 10 is shown. Gaming machines are sometimes referred to as a gaming system, slot machines, electronic gaming machines (EGM's), poker machines, pokies, video lottery terminals (VLT's), gaming terminals, video slot machines, and video gaming machines, and all such machines typically operate in a similar manner in that a player places something of value at risk on an outcome that is unknown and uncertain to the player, and the machine displays the associated outcome, thereby informing the player of the resolution associated with their placing said something at risk.

Gaming machine 10 includes cabinet 15 which typically houses sensitive components of the gaming machine 10. Cabinet 15 can be made from wood, metal, or any other structurally secure material. The sensitive components housed within the cabinet could include electronics, money handling devices, computing devices, communication devices, and other such components that a gaming machine manufacturer does not wish public access to.

Gaming machine 10 is shown in FIG. 1 with a candle 20. Such candles can be utilized by casinos to communicate machine malfunctions or other issues associated with gaming machine 10 to floor personnel who attend to the casino floor. Typically, dependent on the issue with the gaming machine 10, the candle 20 can be light up in different colors, which help floor personnel discern what the issue is with the gaming machine 10.

Gaming machine 10 is also shown with a coin tray 25. More recently, such coin trays are obsolete as most gaming machines do not accept coins or have an associated coin hopper to dispense coins. However, coin trays such as coin tray 25 can still be part of gaming machines for aesthetic purposes, or for simplification of manufacturing for those instances where a gaming machine is required to dispense coins. In one embodiment, coin tray 25 can be lit by multicolored lights to help attract players to gaming machine 10.

Gaming machine 10 has a primary display 30, which is utilized to display the primary game. The primary game display can be a mechanical or electromechanical display, such as a set of physical reels, or it can be a video display, such as a light emitting diode (LED) display, a liquid crystal display (LCD) including LED-backlit LCD's, a plasma display, an electroluminescent (EL) display, an organic light emitting diode (OLED) display, a cathode ray tube (CRT) display, a surface-conduction electron-emitter display (SED), a digital light projection (DLP) display, a polymer light-emitting diodes (PLED) display, an LCD projection display, any combination thereof, or any other display capable of displaying video. It is also contemplated that primary display 30 has an associated touchscreen which overlays the primary display 30, which would allow a player to touch portions of the screen in order to input selections or other commands. Use of such touchscreens are common on gaming machines.

It is further contemplated that primary display 30 can be a traditional 2-D display, or a 3D display. It is also contemplated that in combining two or more displays into primary display 30, that at least the display closest to the player would have portions which are transparent or translucent in order to enable viewing of a display further from the player.

In one example of such an embodiment, the display closest to the player is an LCD display, which is aligned in front of mechanical reels, which together provides a player with the experience of both video and traditional mechanical reels in a play of the gaming machine 10. In another example of such an embodiment, two or more LCD displays are provided, which can be utilized to present a 3-D display to the player.

Gaming machine 10 also includes a secondary display 35, which can be the same type of display as primary display 30, or can be any other type of display as identified above in relation to the primary display 30. Secondary display 35 can be utilized to provide information to the player, such as paytable information or information on a particular bonus game, or it can be utilized to play a portion of a game, such as a bonus game. It is also contemplated that secondary display 35 could be utilized to provide additional information related to the primary game of gaming machine 10. For example, it could display the results of the primary game, it could show the payline layout, it could identify any wins in the primary game, or any other information that a gaming machine manufacturer thinks might help the player enjoy their experience.

Also included with gaming machine 10 is information display 40. It is contemplated that such a smaller display could be utilized to provide condensed information to a player, such as information relating to the current play of the game. For example, information display 40 could display the number of paylines wagered on, the wager per line, and the total bet for a play of the game. Again, it is contemplated that information display could be the same type of display as primary display 30, could be an LED dot matrix type of display, or could be any other type of display as identified above in relation to the primary display 30. It should also be understood that while gaming machine 10 is being shown with 3 distinct displays, primary display 30, secondary display 35, and information display 40, that more or less displays could be utilized without departing from the scope or spirit of the present disclosure. For example, it is contemplated that gaming machine 10 could have only a single display.

It is contemplated that gaming machine 10 has one or more input devices such as buttons 45. Buttons 45 could be utilized by a player to select components of their game, such as the amount of their wager or how to allocate their wager within the game, and allow them to initiate the play of the game, for example by selecting a "Spin" button or other play initiating button. It is contemplated that buttons 45 can be physical buttons or virtual buttons, such as a touchscreen input, or a combination thereof. In one embodiment, buttons 45 include video displays, such as an LCD, which in turn allows the gaming machine 10 to be converted to a different title or style of game without having to replace buttons 45.

Gaming machine 10 also includes speakers 50. It is contemplated that speakers 50 can work independently of each other, work in coordination with each other, work in coordination with other speakers, for example speakers located in a player seat associated with gaming machine 10, work as part of a surround sound system, or any combination thereof.

Gaming machine 10 also includes a currency acceptor 55. In one embodiment, currency acceptor 55 is a bill acceptor which accepts physical indicia of monetary value such as paper money. In another embodiment, currency acceptor is a coin acceptor which accepts coins. In still another embodiment, gaming machine 10 includes more than one currency acceptor 55. In another embodiment, currency acceptor 55 can accept multiple denominations of currency, or even currencies from multiple countries. In still another embodiment, currency acceptor can accept a ticket or similar indicium that is distributed by a casino or another gaming machine, which indicates an amount of currency available for use on gaming machine 10. In a further embodiment, currency acceptor 55 can accept credit cards, debit cards, or other instruments to initiate an electronic funds transfer. It is also contemplated that instead of a currency acceptor 55, the gaming machine 10 provides another means to allow a player to access money in order to wager on a play of the game. For example, the player may enter a PIN in order to access an account they have, either with a bank or the casino itself, and upon entering the PIN and other information, certain amount of funds are transferred to the gaming machine 10 or otherwise allowed to be wagered via gaming machine 10. In another embodiment, currency acceptor 55 is configured to interact with a radio frequency identification (RFID), a Bluetooth, a near-field communication (NFC), a WiFi, and/or other short-range or medium-range communication devices which can transmit financial information short and/or medium distances, for example a bracelet, smart watch, smart phone, or other similar devices.

The gaming machine 10 of FIG. 1 is also shown with a ticket printer 60, which is utilized to cash money out of gaming machine 10. It is common now that gaming machines accept currency, but will only provide a ticket upon cashout, and then the holder of the ticket must take the ticket to the cashier's cage or a ticket redemption kiosk in order to obtain the currency indicated by the ticket. For gaming machine 10, it is contemplated that after a player elects to cashout by selecting an appropriate button 45, printer 60 prints out a tickets which indicates the amount of currency the player elected to cashout, and the player can then take the ticket and insert it into another gaming machine, or visit a cashier's cage or a ticket redemption kiosk to exchange the ticket for currency. In one embodiment, currency acceptor 55 and ticket printer 60 can be combined into one unit and/or one player interface. For example, a player may insert multiple forms of physical indicia of monetary value, such as tickets and paper money, at the same location (e.g., currency acceptor 55), and receive tickets from the same interface as to where the player inserted the physical indicia of monetary value.

Gaming machine 10 also includes a player tracking device 65. It is contemplated that gaming machine 10 could include a visibly distinct player tracking device 65, or a visually integrated player tracking device that utilizes a portion of the primary display 30 and associated touchscreen in order to interact with a player. In practice, a player makes their identity known to the player tracking device 65, either actively by inserting a player tracking card and/or entering a PIN into player tracking device 65, or passively by utilizing a location device, such as a radio frequency identification (RFID) or a Bluetooth device which can transmit information short distances. Thereafter, the player tracking device 65 communicates over a network with a casino tracking system (not shown) to track a player's play, and potentially offer awards or other services to the player, often through the same player tracking device 65. The player tracking device 65 can also display player status information back to the player, or other information based on or otherwise related to a player's play history and/or status, including awards earned by a player. It is also contemplated that the networked player tracking device 65 can be utilized to offer other services to players, such as the ordering of drinks, or making promotional offers to a player, perhaps working in coordination with ticket printer 60 to do so.

Figure 2:
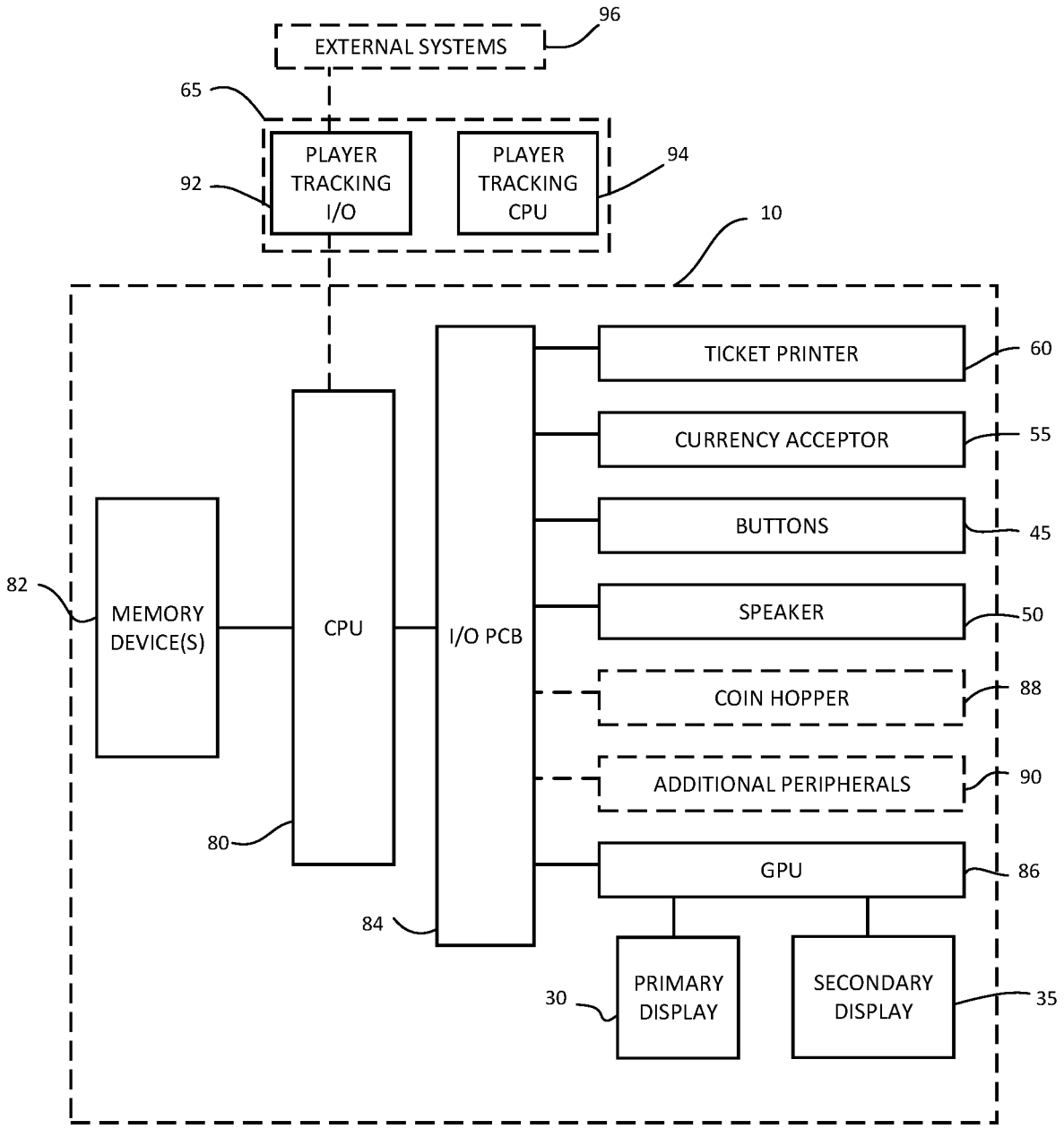
FIG. 2 is schematic view of a gaming system, in accordance with an embodiment of the present disclosure.

FIG. 2 is a schematic diagram of a gaming system in accordance with one embodiment of the present disclosure. In this embodiment, gaming machine 10 utilizes a computer processing unit (CPU) 80, such as a processor, a microprocessor, or the like. CPU 80 can perform arithmetic and logical operations, and also extract instructions from memory device(s) 82 and decodes and executes them. Alternatively, it is contemplated that instead of CPU 80, an array processor or vector processor has multiple parallel computing elements, which utilizes a distributed computing model, to perform such arithmetic and logical operations.

Memory device(s) 82 can include one or more distinct types of memory devices, such as random access memory (RAM) or dynamic RAM (DRAM), which can include non-volatile RAM (NVRAM), magnetic RAM (MRAM), ferroelectric RAM (FeRAM) and other forms as commonly understood in the computing industry. In one embodiment, the memory device(s) 82 includes read only memory (ROM), which may, for example, store regulatory-sensitive instructions for gaming machine 10. In one embodiment, the memory device(s) 82 includes flash memory and/or EEPROM (electrically erasable programmable read only memory). Any other suitable magnetic, optical and/or semiconductor memory may operate in conjunction with the gaming device 10 disclosed herein.

In some embodiments, memory device(s) 82 store program code that is executable by CPU 80. Memory device(s) 82 may also store operating data, such as a random number generator (RNG), game instructions, event data, display files, game history data, and other such data and instructions that allow for a gaming device to properly function in a regulated environment.

CPU 80 is communicatively connected to at least one input/output device 84 which may include an integrated circuit (IC), and/or a printed circuit board (I/O PCB) and which operates as an electrical interface between CPU 80 and various peripherals of the gaming machine 10. FIG. 2 further illustrates various peripherals, including ticket printer 60, currency acceptor 55, buttons 45, speakers 50, as well as possible peripherals coin hopper 88, and other additional peripherals 90. Also illustrated is a graphic processing unit (GPU) 86, which works in coordination with CPU 80 to control the primary display 30 and secondary display 35, and causes them to display various aspects of a game.

Also communicatively connected to CPU 80 is a player tracking device 65. It is contemplated that the player tracking device 65 includes a distinct player tracking input/output (I/O) 92 and player tracking CPU 94, as well as associated player tracking memory (not shown). In one embodiment, it is contemplated that player tracking device 65 could have a direct line of communication with ticket printer 60. In such an embodiment, the player tracking device 65 could then cause ticket printer 60 to print out promotional tickets without having to first communicate with gaming machine CPU 80, which may be desirable from a regulatory view. FIG. 2 also illustrates that gaming machine 10 is communicatively connected to external systems 96, which could include one or more of an accounting system, player tracking system, player bonusing system, player assistance system, server-based gaming system or other game content management system, wide area network (WAN), local area network (LAN), the internet, or other communication systems.

Games offered on gaming machines such as gaming machine 10 can be widely varied and diverse. However, all such games typically must meet very stringent requirements, which assure their fairness and perhaps even their appearance of fairness. Generally speaking, games must return to players, in the form of monetary awards, on average, somewhere between 75% and 100% of all wagers accepted, which is referred to as payback percentage. Specific payback requirements are specific to each of the hundreds of regulated gaming jurisdictions worldwide, but as a general manner, fall within such a range, and must be statistically verifiable over numerous plays. Many such jurisdictions have additional requirements related to how a game outcome is determined, whether the outcome is completely random, primarily random, unpredictable by a player, or to what affects a player's skill level can have on an outcome. It is the requirement to meet such stringent regulations that truly limit the features that can be designed into a game for gaming machine 10.

Some of the more popular game styles involve distinct reels of symbols which spin, and then stop after which the symbols which are viewable are evaluated, often in relation to one or more paylines, to determine if an arrangement of the viewable symbols meets predefined relationship criteria which define wins, which has associated awards. Variations of this example includes changes to the layout, number, type, and location of reels, the associated symbols, and paylines, how the predefined relationship criteria are applied, and additional functionality applied to certain symbols, such as wild symbols, multiplier symbols, expanding symbols, stacked symbols, multi-symbols, scatter symbols, and combinations thereof.

More recently, games appearing similar to such casino games are becoming more prevalent through social media outlets, such as Facebook® (registered trademark of Facebook, Inc.), where they are played for non-redeemable or non-cashable credits. In such configurations, these "social" or "non-wagering" versions of casino games do not have to abide by such stringent regulations, and often do not. For example, such games do not have to be truly random, do not have to have a verifiable payback percentage, are not required to maintain the same payback percentage for each play of the game, and are not subject to a minimum or maximum payback percentage. In such non-wagering embodiments, these games can be tailored more to a particular player or player profile, and can be more reflexive in nature in an effort to increase player entertainment. The methods disclosed herein can be applied to such social games, as it is believed that the novel approach to modify a future play of the game, combined with the relative ease of understanding the method, would be equally desirable in such social and non-wagering environments. In such embodiments, it should be understood that instead of modifying a future wager, the methods disclosed herein would modify a future offer to play the game.

Figure 3:
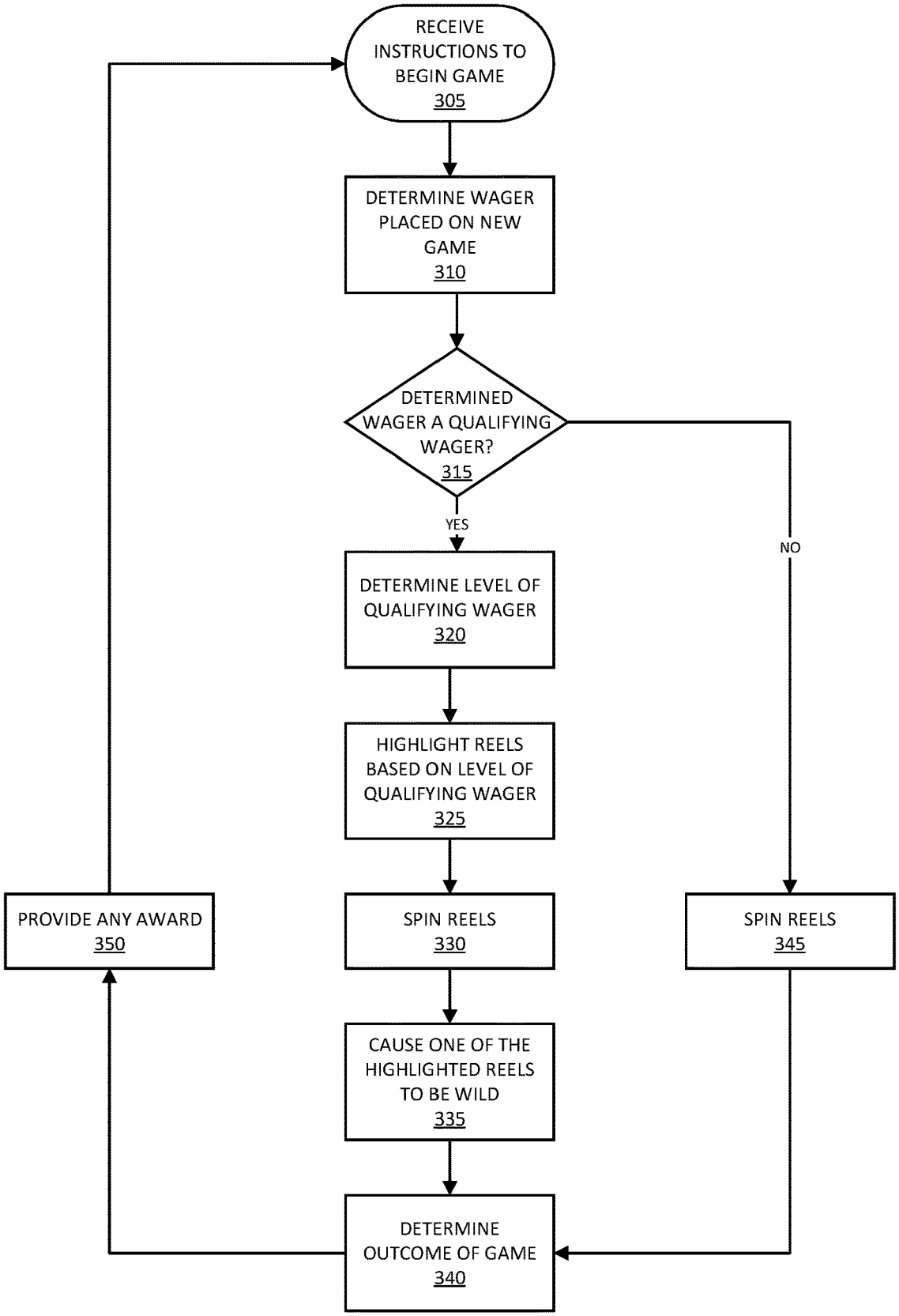
FIG. 3 is a flowchart illustrating how a gaming system, in accordance with an embodiment of the present disclosure, would be configured.

Referring to FIG. 3, a flowchart of how one embodiment of the present disclosure may be configured is discussed. At step 305, the gaming system receives instructions to begin a play of the game. These instructions are, in one embodiment, caused by the player interacting with at least one input device, such as a "spin" button or a "play" button, which is communicated to the gaming system CPU. In the flowchart of FIG. 3, step 310 is illustrated next where the gaming system determines the wager placed on the new play of a game. It should be understood that while step 310 is shown to occur after step 305, it is contemplated that a gaming system could be configured so that step 310 occurs before, or contemporaneously with, step 305, and the order of such steps are not dispositive on defining the scope of the present disclosure. In one embodiment, the wager placed on the play of a new game is greater than or equal to a minimum wager. In another embodiment, the wager placed on a new game is a multiple of the minimum wager. In still another embodiment, the minimum wager is a plurality of credits. In a further embodiment, the gaming system provides a plurality of preset wager levels. In still a further embodiment, such preset wager levels are not multiples of the minimum wager.

At step 315, the gaming system determines whether the determined wager at step 310 is a qualifying wager. In one embodiment, any wager above the minimum wager is a qualifying wager. In another embodiment, there are multiple qualifying wager levels and multiple non-qualifying wager levels. In another embodiment, each determined wager at step 310 is a qualifying wager. In such an embodiment, step 315 may be bypassed as each possible wager is a qualifying wager. In another embodiment, there are more qualifying wager levels then there are reels. For example, a player may have the option of six different qualifying wager levels for a five-reel game. In such an example, the first qualifying wager level allows for only the fifth reel to be a WILD reel; the second qualifying wager level allows for either the fourth or fifth reel to be a WILD reel; the third qualifying wager level allows for one of the third, fourth, or fifth reels to be a WILD reel; the fourth qualifying wager allows for one of the second, third, fourth, or fifth reels to be a WILD reel, the fifth qualifying wager allows for one of the second, third or fourth reels to be a WILD reel, and the sixth qualifying wager allows for one of the second or third reels to be a WILD reel. As can be appreciated, in such an embodiment, the player may wager more to assure that they get a WILD reel within the first three reels, and that would generally lead to more wins.

If at step 315 it is determined that the wager is not a qualifying wager, the gaming system proceeds to step 345 of spinning the reels or otherwise displaying the results of the game. From there, the gaming system proceeds to step 340 and determines the outcome of the game based on the results of the reel spin, and then provides any award based on the determined outcome at step 350. Again, while the present embodiment discusses reels, it is contemplated that other game outcome presentation methods are also applicable. From step 350, the gaming system proceeds back to step 305 for the next play of the game.

If at step 315, the gaming system determines that a qualifying wager was placed, the gaming system then determines the level of the qualifying wager at step 320. It is contemplated that the gaming system will offer multiple levels of qualifying wager opportunities from which a player can select from. In one embodiment, as illustrated below, a gaming system may offer five preset wagering levels, wherein the minimum wagering level is not a qualifying wager level, but each of the remaining four wagering levels are qualifying wagering levels.

In the present embodiment, the gaming system will then highlight a number of reels based on the determined level of the qualifying wager at step 325. It is contemplated that by highlighting the reels for the player, the gaming system can effectively communicate to the player the benefits or effects of the player making such qualifying wagers. In such a manner, the present disclosure can effectively provide a new opportunity to a player in a simple an easy manner In one embodiment, when the gaming system determines that the minimum qualifying wager was placed, the gaming system will highlight the last reel. In another embodiment, when the gaming system determines that the second lowest minimum qualifying wager was placed, the gaming system will highlight the last two reels. In a further embodiment, when the gaming system determines that highest qualifying wager was placed, the gaming system will highlight each of the reels except the first reel. In another embodiment, it is contemplated that the gaming system will not highlight reels. In such an embodiment, step 325 would not be part of the processing performed by the gaming system. It is also contemplated that in such an embodiment, the effect of making the qualifying wager is conveyed to the player through other means, such as by messaging appearing on the display device of the gaming system. In another embodiment, the reels are physical reels, and the highlighting of the reels is done by lighting of the mechanical reels.

At step 330, the gaming system spins the reels or otherwise begins the presentation of the game determination. At step 335, the gaming system then determines one of the highlighted reels to be a WILD reel. In one embodiment, this determination is based on a random determination and weighted probabilities associated with each of the highlighted reels. For example, if only one reel is highlighted, that reel will be the WILD reel. In continuing with that example, if four reels are highlighted, each reel may have a separate probability of being determined to be the WILD reel. In another example, each highlighted reel will have the same or substantially the same probability of being determined to be the WILD reel.

In one particular embodiment, as illustrated in Table 1-A below, it is contemplated that the third reel, in a common five-reel configuration, would always have the lowest probability to be determined as the WILD reel. This is because in most five-reel game offerings, winning combinations require the first three symbols to match, so providing a WILD reel as the third reel would have more impact on increasing winning combinations. However, providing a higher probability that the second reel is a WILD reel would not make as great of impact on increasing awards, but it is contemplated that it would provide greater player excitement.

TABLE 1-A

| | | 50 credits | 70 credits | 80 credits | 90 credits | 100 credits |
|---|---|---|---|---|---|---|
| WILD Reel Position | Reel 5 | 0% | 100% | 75% | 50% | 45% |
| | Reel 4 | 0% | 0% | 25% | 40% | 40% |
| | Reel 3 | 0% | 0% | 0% | 10% | 5% |
| | Reel 2 | 0% | 0% | 0% | 0% | 10% |

In one embodiment, it is contemplated that the determined WILD reel would be stopped and displayed to the player prior to other reels being stopped. It is contemplated that by stopping the WILD reel first, the player will have more opportunity to understand the effects of the WILD reel and therefore would comprehend the results of the game quicker. It is also contemplated that by stopping the WILD reel first, it would increase excitement and anticipation for the player. In one embodiment, the determined WILD reel is stopped or otherwise indicated in a manner that it is not perceived to have stopped or otherwise indicated in the same cadence as the remaining reels are stopped at. For example, the WILD reel may stop, then 1 second later, the next reel stops, then the next reel stops ¼-second later, and the next reel stops a ¼-second later, and then the final reel stops a'4-second later. As is illustrated, the WILD reel stopped and then there was a perceived gap before the remaining reels stopped.

In another embodiment, the gaming system provides an audiovisual display to highlight the WILD reel. In another embodiment, the WILD reel simply displays an exhibition, and does not include the word "WILD." In another embodiment, the gaming system comprises physical reels, and a determined WILD reel is differentiated from the other reels via different lighting or lighting effects.

In another embodiment, the WILD reel has a separate determination that could provide additional benefits, such as adding a multiplier to the WILD reel. In such an example, it is contemplated that the gaming system makes as part of its determination of which of the highlighted reels is a WILD reel, whether to add a 2× multiplier to any wins associated with the WILD reel. It is contemplated that such a determination could have an additional audiovisual display to increase excitement. In another embodiment, the likelihood of such a separate determination occurring is based on the wager by the player. For example, the more a player wagers, the more likely they are to receive a multiplier added to their WILD reel.

At step 340, the gaming system determines the outcome of the game based on the displayed symbols. At step 350, the gaming system then provides any awards based on the displayed outcome, and then returns to step 305.

Figure 4A:
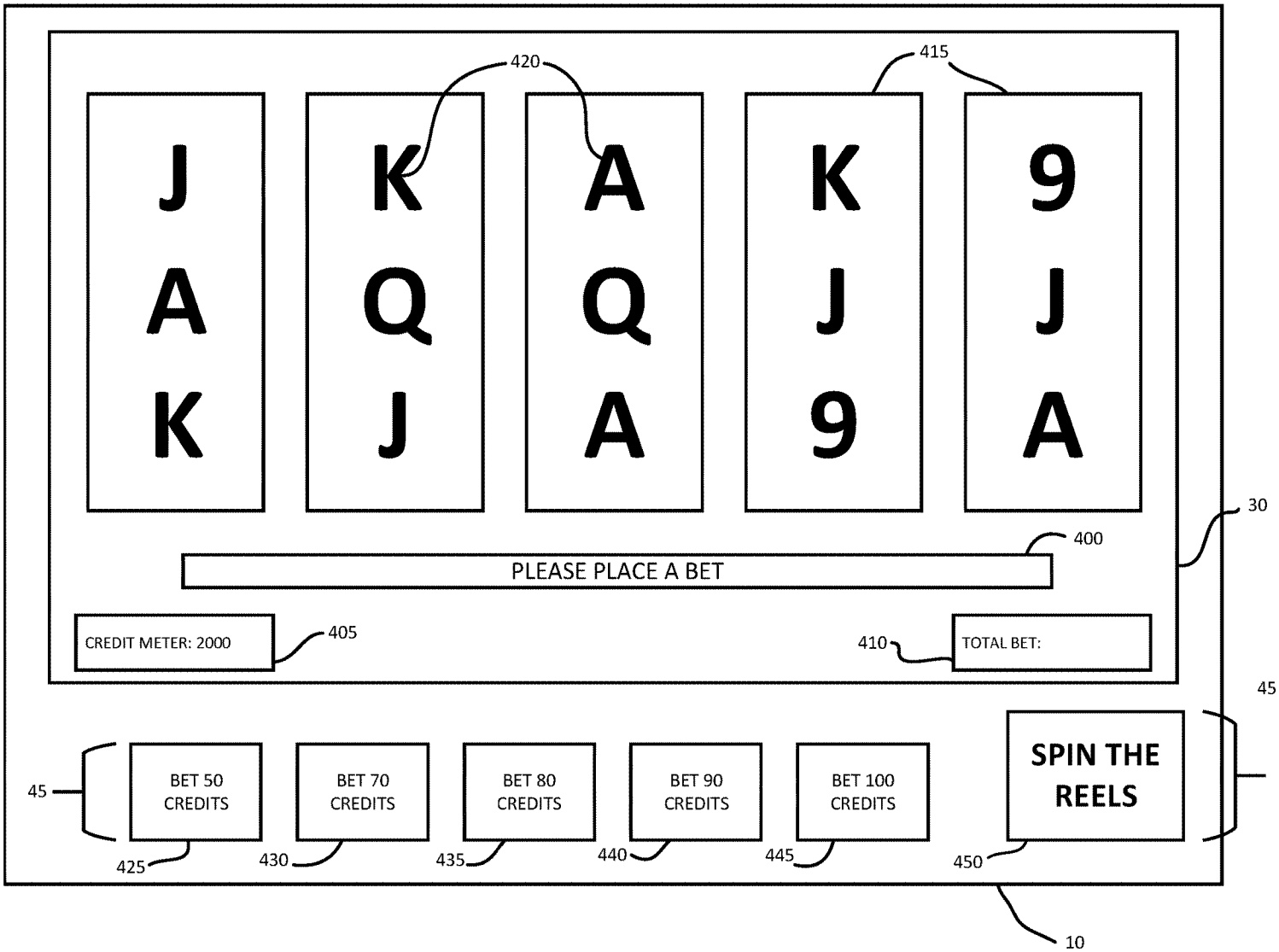
FIGS. 4A, 4B, 4C, 4D, 4E, 4F, 4G, 4H, 4J, 4K, 4L, and 4M are front plan views of one embodiment disclosed herein of a gaming device indicating the generation of symbols, highlighting reels based on a determined level of a qualifying wager, causing a highlighted reel to be wild, and determining the outcome of the game.

FIGS. 4A through 4M illustrate an example of how a gaming system, configured in accordance with FIG. 3, might operate. At FIG. 4A, gaming system 10 has buttons 45, and specifically bet buttons which are associated with betting, or wagering, various levels of credits 425-445, and a spin button 450 which initiates a play of a new game. The gaming system also has a primary display 30 which, in this example, displays five reels 415 which display various game symbols 420. The primary display 30 also displays a credit meter 405, which displays the number of cashable credits associated with the player and/or gaming system. The primary display 30 also includes a player bet meter 410, which displays the bet or wager currently being registered by the gaming system. Primary display 30, in this example, also includes a messaging box 400, which at FIG. 4A reads "PLEASE PLACE A BET." However, it is contemplated that alternative messaging can be included with such features based on the desired effect by the game designer.

Figure 4B:
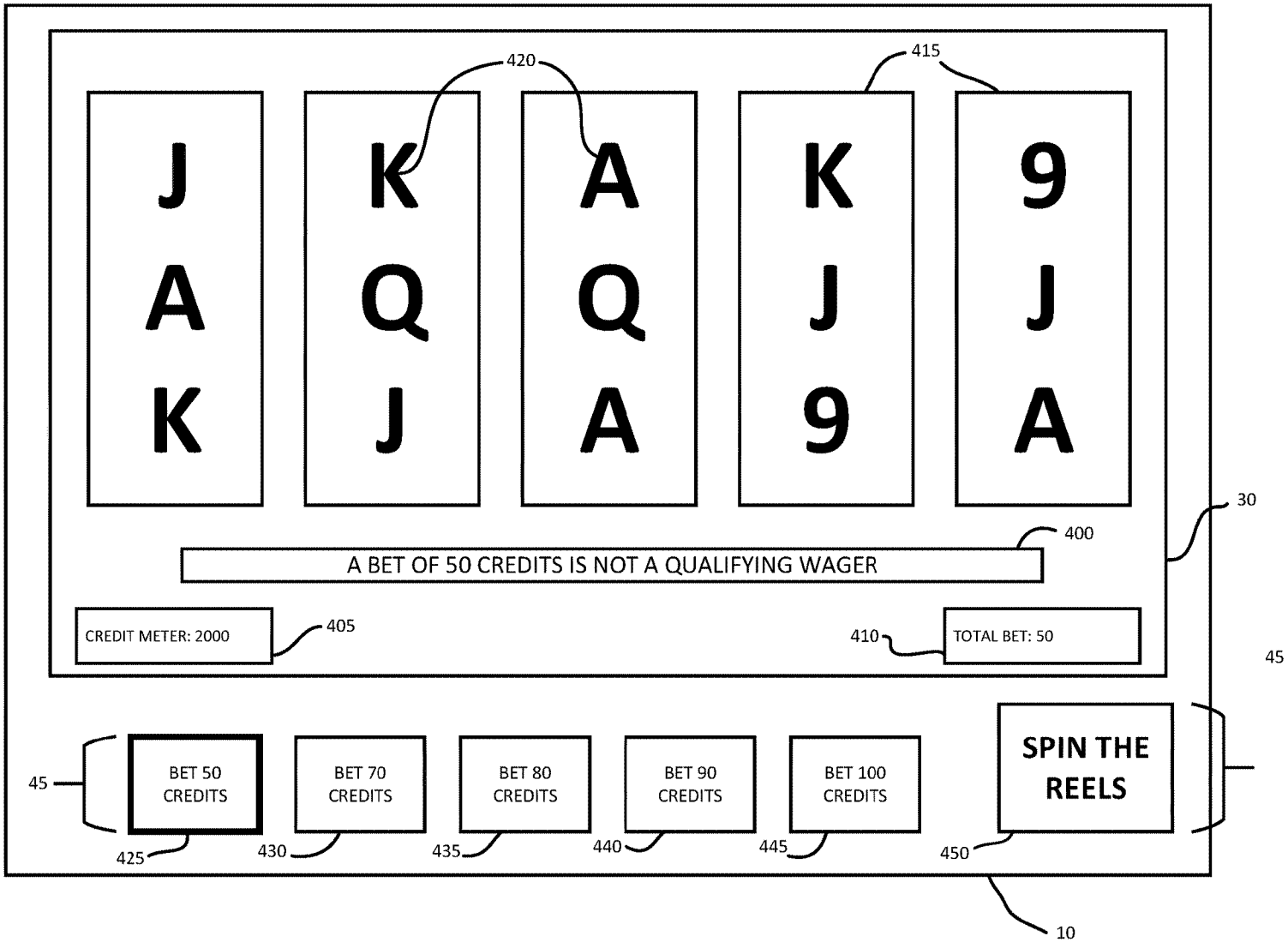

Referring to FIG. 4B, and continuing with this example, a player has selected the "BET 50 CREDITS" button 425 (as indicated by the highlighted box). This is further confirmed by the bet meter 410 displaying a bet of 50 credits. However, the credit meter 405 is still illustrating the original amount of 2000 credits as the player has not yet selected the spin button 450, so a player may change their bet at this stage. Further, messaging box 400 informs the player that the currently selected bet is not a qualifying wager.

Figure 4C:
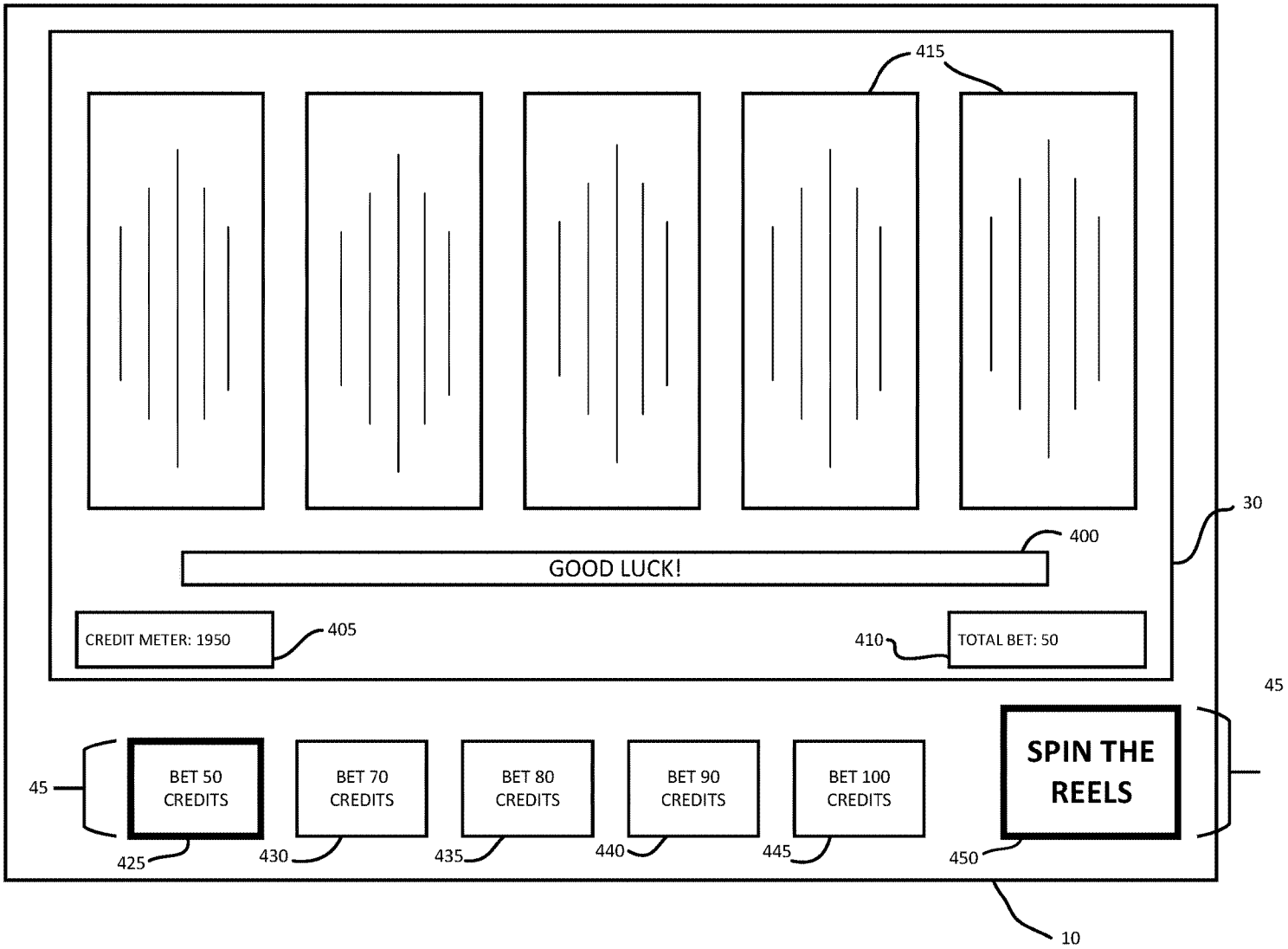

In FIG. 4C the player has pressed the spin button 450 causing the reels 415 to spin. Further, in this embodiment, the press of the spin button 450 confirms the wager, so credit meter 405 is decremented by the wager amount of 50 credits.

Figure 4D:
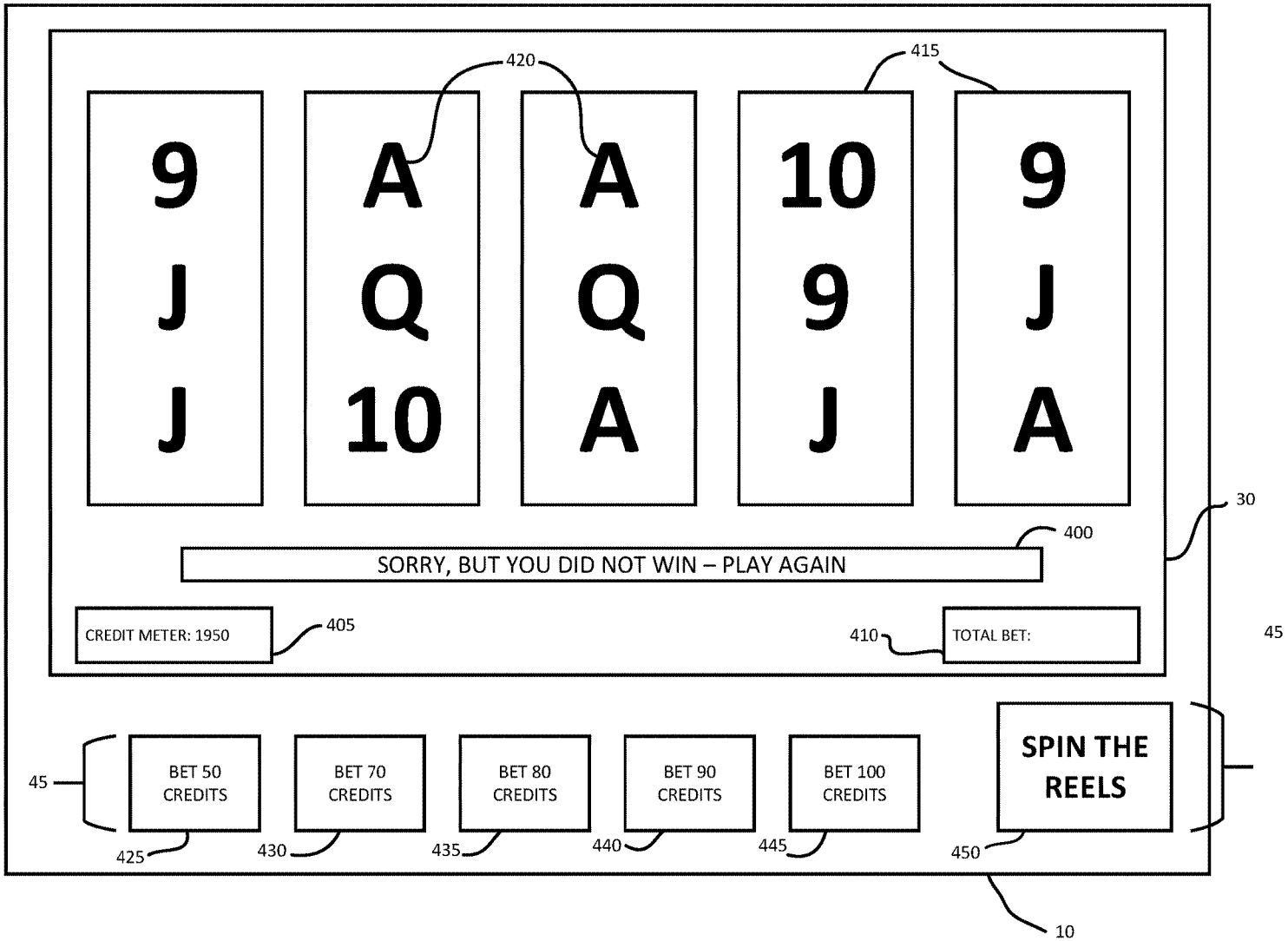

Continuing with this example, in FIG. 4D, the reels 415 have stopped spinning, and the gaming machine determines that the outcome of the game is not a winning outcome. This is conveyed to the player in the messaging box 400 with the message "SORRY, BUT YOU DID NOT WIN—PLAY AGAIN."

Figure 4E:
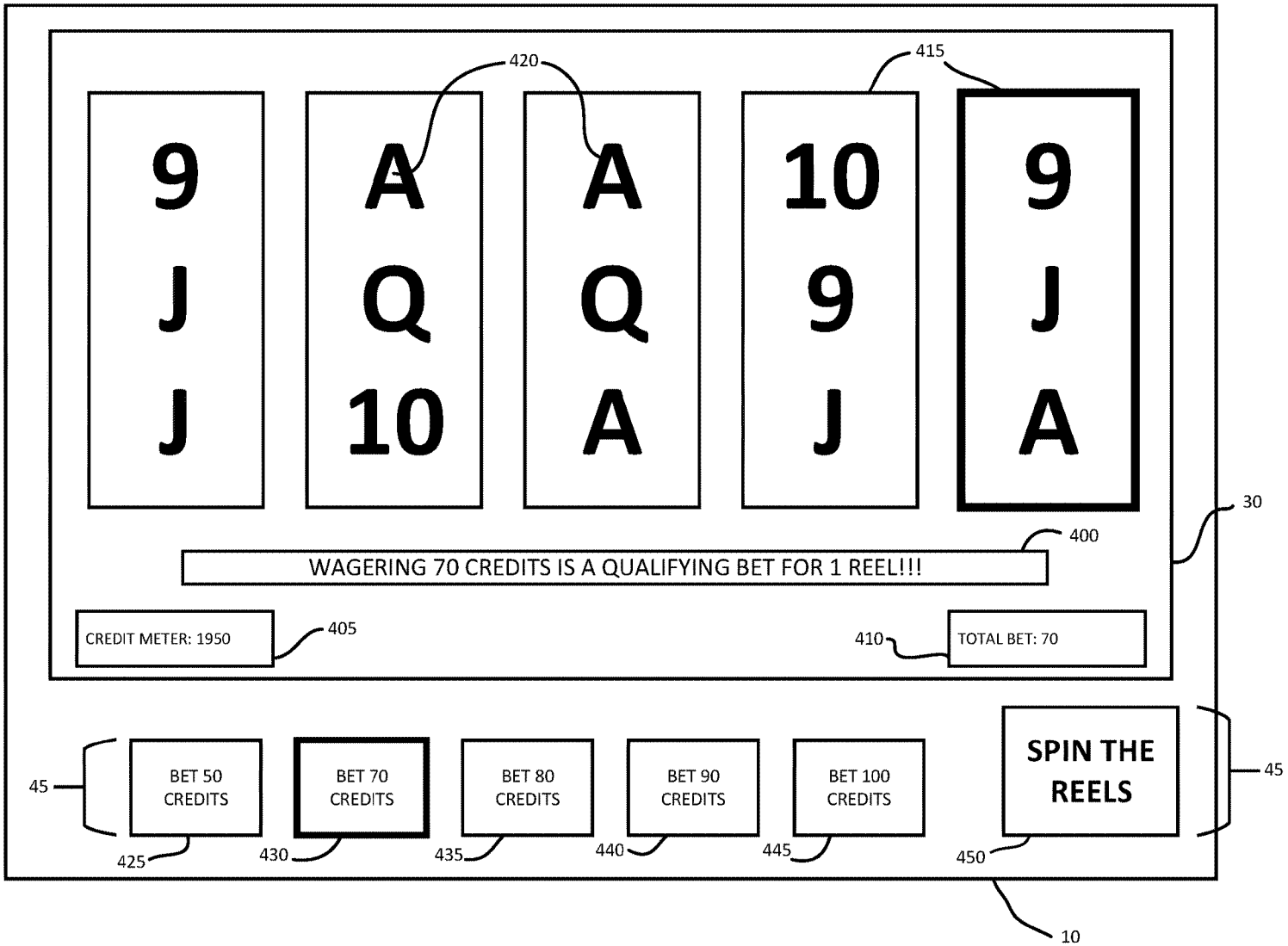

In FIG. 4E, the player now ups their bet by selecting the button to bet 70 credits 430. As indicated by messaging box 400, this is a qualifying bet for one reel to become a WILD reel. This is further illustrated in FIG. 4E by the highlighting of the fifth reel for the player.

Figure 4F:
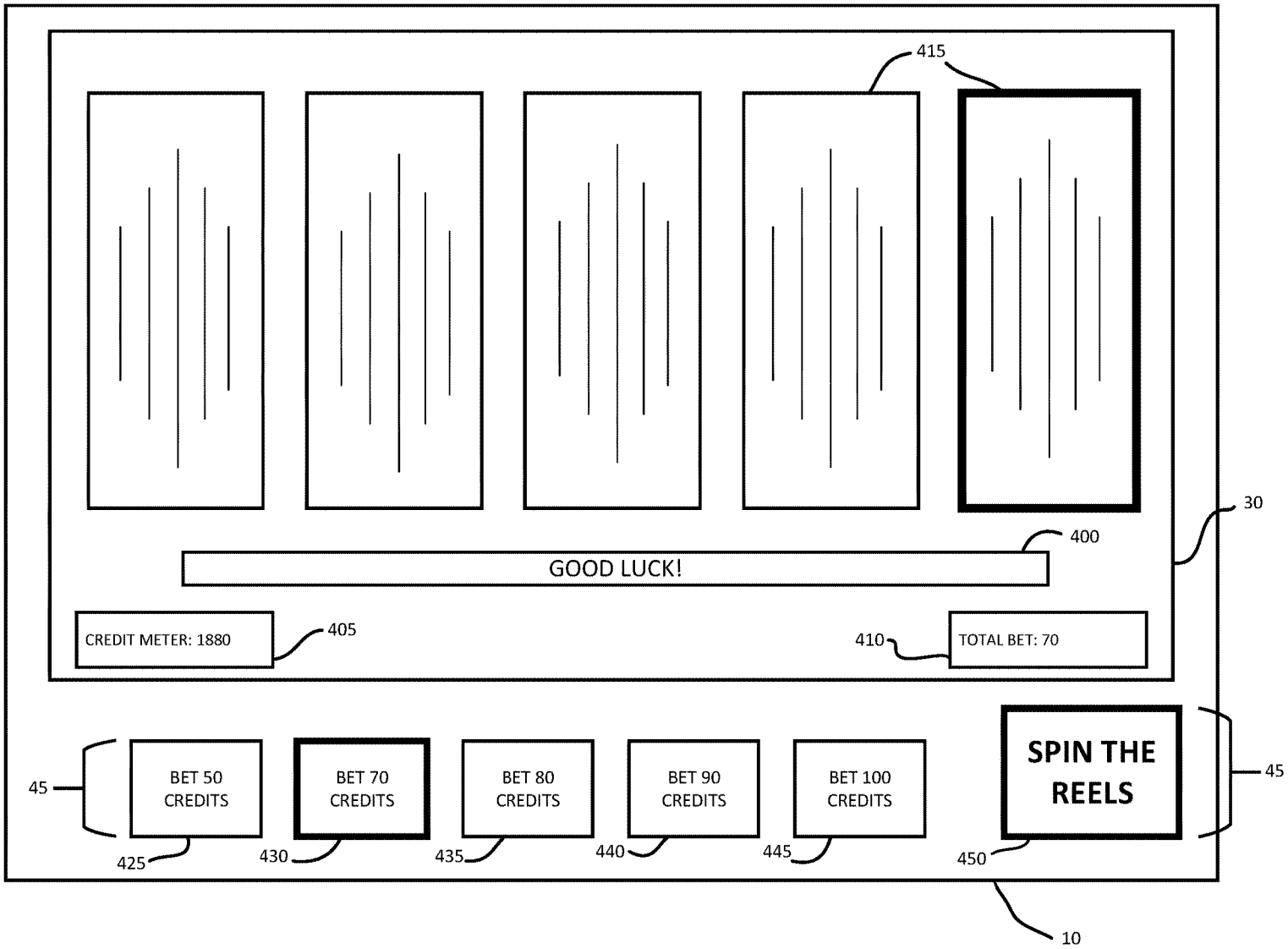

In FIG. 4F the player pressed the spin button 450, which confirms their wager of 70 credits as indicated by bet meter 410. Further, the credit meter 405 has decremented by the same 70 credits. The pressing of the spin button 450 causes the reels 415 to spin.

Figure 4G:
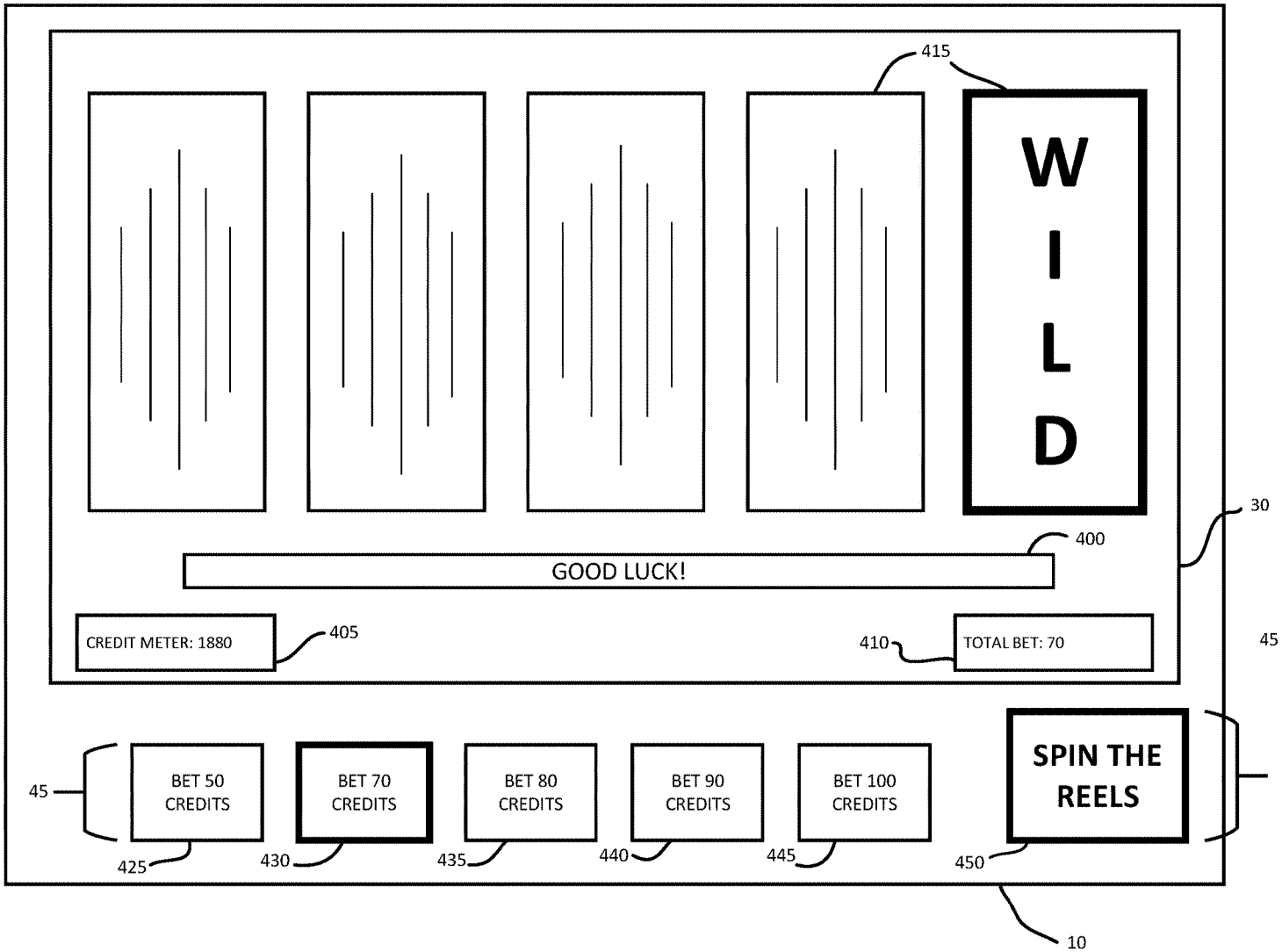
Figure 4H:
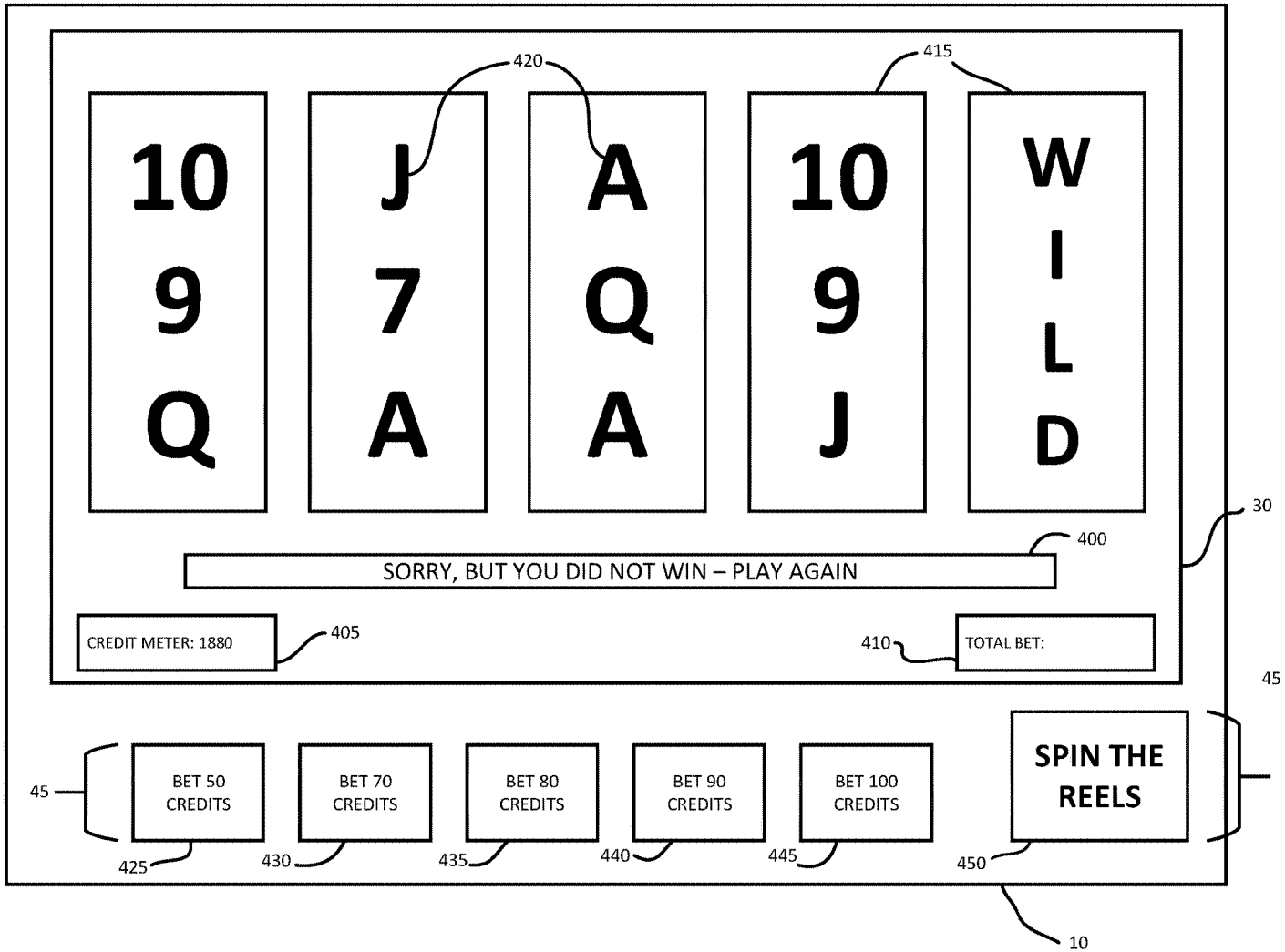

Continuing with this example, FIG. 4G illustrates that while the reels 415 continue to spin, the fifth reel stops first and indicates that it was selected as the WILD reel. In the present example, a player is guaranteed of receiving a WILD reel if they make a qualifying bet, so in this situation where the player has made the minimum qualifying bet, and only one reel is highlighted, they are guaranteed to have that sole highlighted reel as a WILD reel.

In FIG. 4H, we see that again, even with a WILD reel, the outcome of the game is not a win for the player. This is again confirmed by the messaging box 400.

Figure 4J:
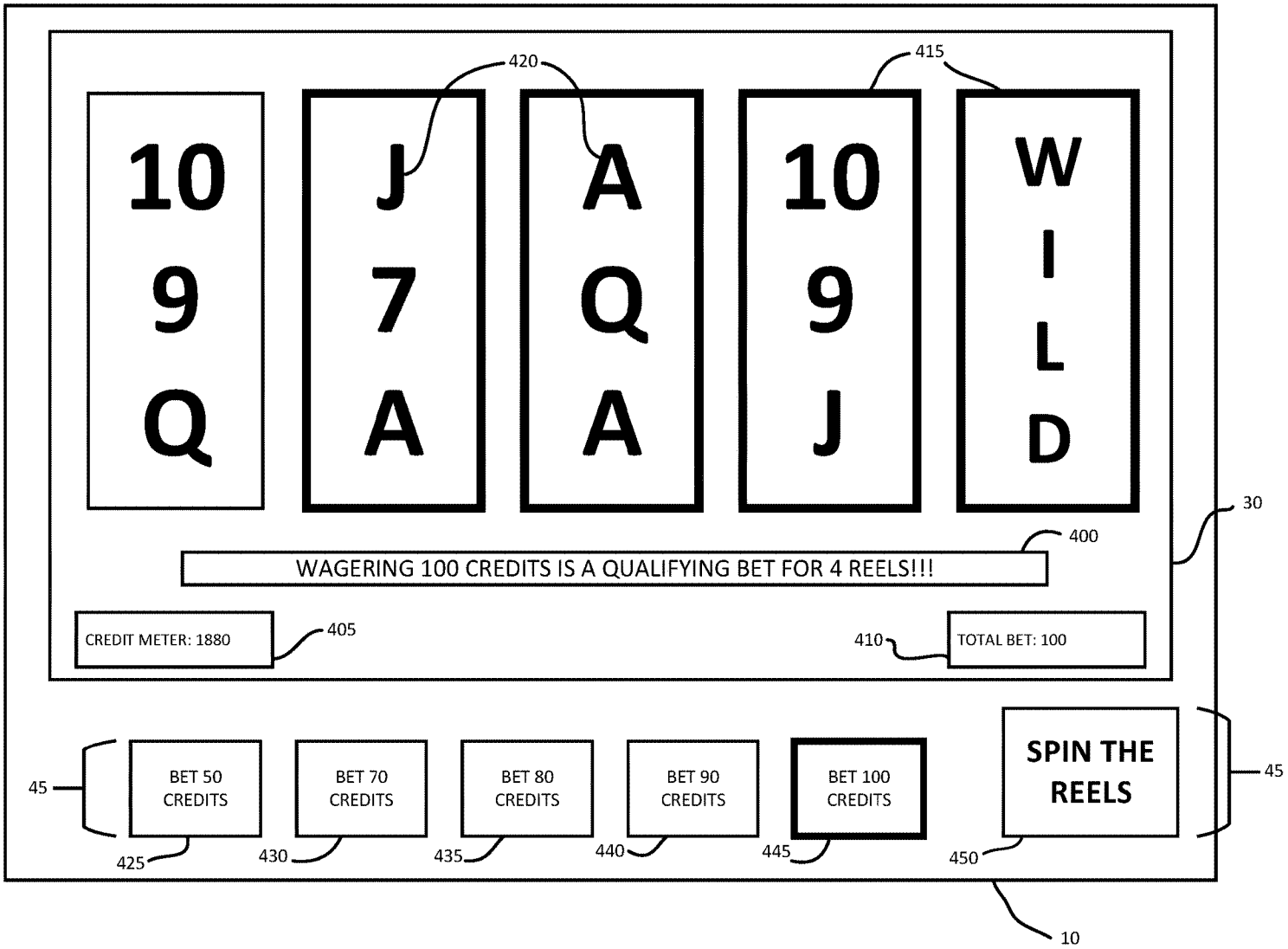

Next, in FIG. 4J, the player has selected the BET 100 CREDITS button 445, which is the maximum bet in this example. The messaging box indicates to the player that this bet is a qualifying bet for four reels, which are themselves highlighted as well to help convey this information to the player. The bet meter 410 additionally displays the current bet selection of 100 credits.

Figure 4K:
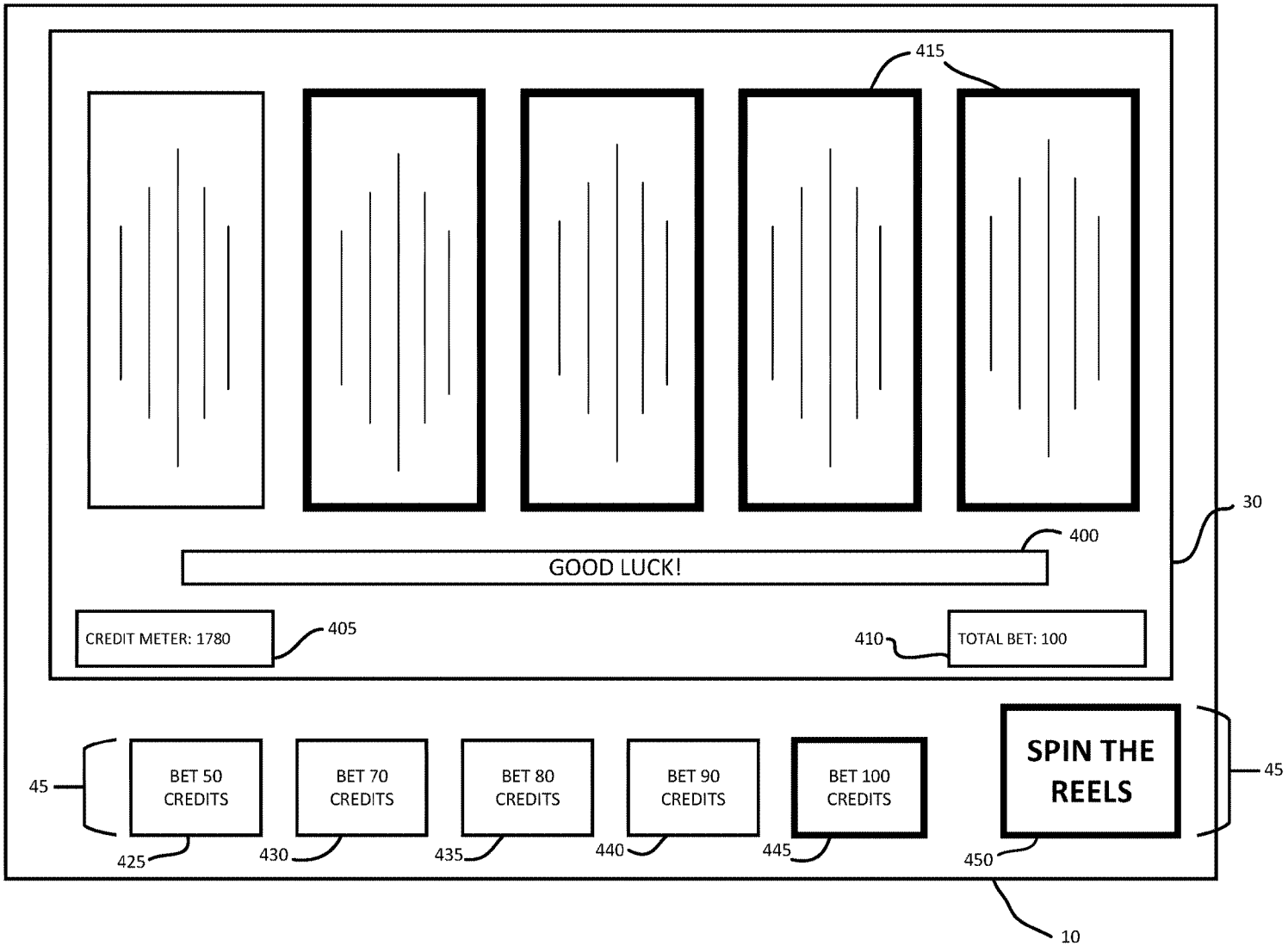

In FIG. 4K, the player has pressed the spin button 450, causing each of the reels 415 to spin. This also causes the credit meter 405 to decrement by the 100 credits wagered.

Figure 4L:
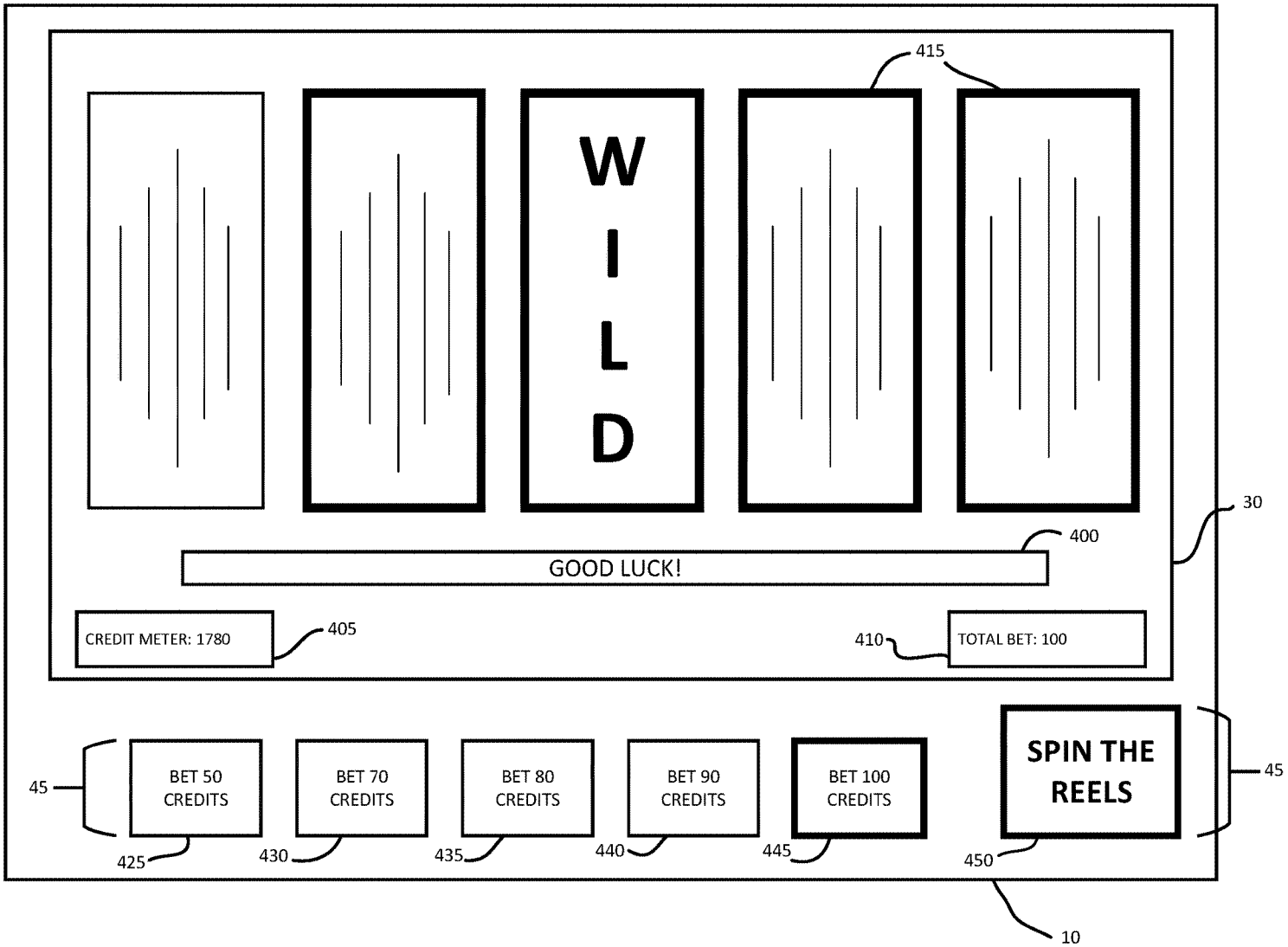

Next, in FIG. 4L, the gaming machine determines one of the highlighted reels to be a WILD reel. In this example, the gaming machine caused the third wheel to be the WILD reel, and caused it to stop first. In this embodiment, the gaming machine selected the WILD reel from the plurality of highlighted reels based on an assigned probability.

Figure 4M:
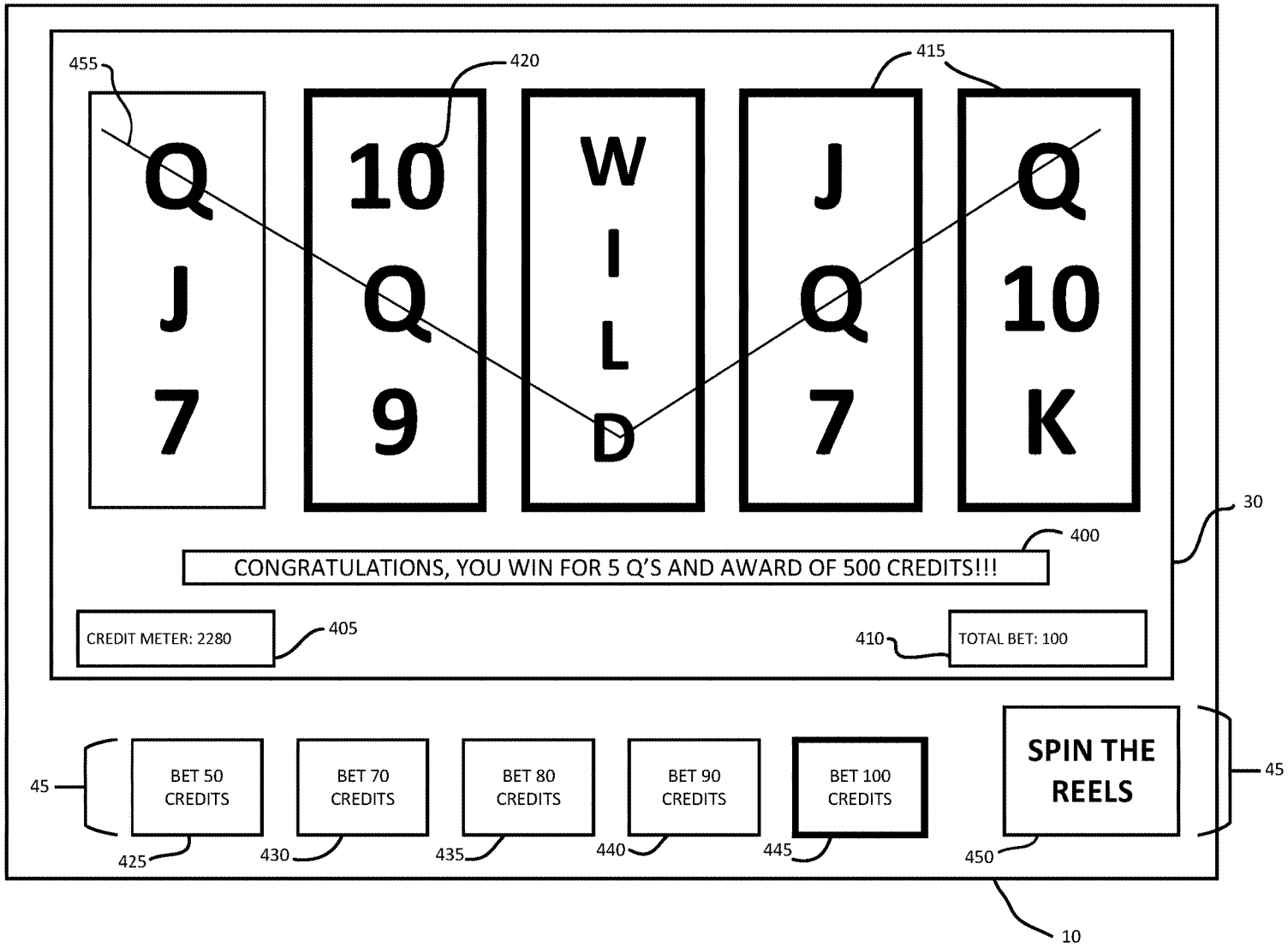

At FIG. 4M, all of the reels have stopped, and the gaming machine determines that the outcome is a winning outcome. Specifically, due to the third reel being a WILD reel, the player wins along the identified payline 455 with a combination of Q-Q-WILD-Q-Q. this is an award of 500 credits, as conveyed by messaging box 400, and as incremented into the credit meter 405.

Although the foregoing idea has been described in detail by way of illustration and example for purposes of clarity and understanding, it will be recognized that the above described idea may be embodied in numerous other specific variations and embodiments without departing from the spirit or essential characteristics of the idea. Certain changes and modifications may be practiced, and it is understood that the idea is not to be limited by the foregoing details, but rather is to be defined by the scope of the appended claims.

What is claimed is:

1. A method for operating a gaming system, the method comprising:

receiving a physical indicia of monetary value via at least one currency acceptor;

validating the receiving of the physical indicia of monetary value;

receiving an electronic communication to begin a new wagering game;

determining a wager associated with the new wagering game;

correlating the associated wager to one of a plurality of different qualifying wager levels;

causing a display device to display a plurality of reels;

causing a number of the displayed plurality of reels to be highlighted based on the correlated qualifying wager level, wherein each of a plurality of the different qualifying wager levels causes a different number of the displayed plurality of reels to be highlighted;

causing the display device to display the spinning of the plurality of reels;

when the number of highlighted reels is equal to one, determining that the highlighted reel is a wild reel;

when the number of highlighted reels is equal to two, determining, based on a probability associated with each of the two highlighted reels, which of the two highlighted reels is a wild reel, wherein the probability associated with each of the two highlighted reels is different;

when the number of highlighted reels is greater than two, determining, based on a probability associated with each of the greater than two highlighted reels, which of the greater than two highlighted reels is a wild reel, wherein the probability associated with a plurality of the greater than two highlighted reels is different;

causing the display device to display any determined wild reel to stop and indicate that the entire reel is wild;

causing each of the reels not determined to be a wild reel to stop;

determining the outcome of the game based on the stopped reels; and when the determined outcome is a winning outcome, providing an award to a player based at least in part on the determined outcome and the determined wager.

2. The method of claim 1, wherein the at least one currency acceptor includes a bill acceptor accepting paper money.

3. The method of claim 1, wherein one of the different qualifying wager levels causes zero of the displayed plurality of reels to be highlighted.

4. The method of claim 1, wherein each of the different qualifying wager levels causes at least one of the displayed plurality of reels to be highlighted.

5. The method of claim 1, wherein there are five different qualifying wager levels and five reels.

6. The method of claim 1, wherein the probability associated with each of the greater than two highlighted reels is different.

7. The method of claim 1, wherein the displayed wild reel comprises an animation.

8. The method of claim 1, wherein the causing the display device to display any determined wild reel to stop comprises causing multiple wild reels to be displayed.

9. The method of claim 1, wherein each of the probability associated with each of the greater than two highlighted reels is determined based on the correlated qualifying wager level.

10. The method of claim 1, wherein at least one of the probability associated with at least one of the greater than two highlighted reels is determined based at least in part on whether a different one of the greater than two highlighted reels has been determined to be a wild reel.

11. A gaming system comprising:

at least one display device;

at least one processor;

at least currency acceptor; and at least one memory device storing a plurality of instructions, which when executed by the at least one processor causes the at least one processor to:

after receiving physical indicia of monetary value via the at least one currency acceptor, validate the receiving of the physical indicia of monetary value;

receive an electronic communication to begin a new wagering game;

determine a wager associated with the new wagering game;

correlate the associated wager to one of a plurality of different qualifying wager levels;

cause the at least one display device to display a plurality of reels;

cause a number of the displayed plurality of reels to be highlighted based on the correlated qualifying wager level, wherein each of a plurality of the different qualifying wager levels causes a different number of the displayed plurality of reels to be highlighted;

cause the at least one display device to display the spinning of the plurality of reels;

when the number of highlighted reels is equal to one, determine that the highlighted reel is a wild reel;

when the number of highlighted reels is equal to two, determine, based on a probability associated with each of the two highlighted reels, which of the two highlighted reels is a wild reel, wherein the probability associated with each of the two highlighted reels is different;

when the number of highlighted reels is greater than two, determine, based on a probability associated with each of the greater than two highlighted reels, which of the greater than two highlighted reels is a wild reel, wherein the probability associated with a plurality of the greater than two highlighted reels is different;

cause the at least one display device to display any determined wild reel to stop and indicate that the entire reel is wild;

cause each of the reels not determined to be a wild reel to stop;

determine the outcome of the game based on the stopped reels; and when the determined outcome is a winning outcome, provide an award to a player based at least in part on the determined outcome and the determined wager.

12. The gaming system of claim 11, wherein the at least one currency acceptor includes a bill acceptor configured to receive the physical indicia of monetary value, wherein the physical indicia of monetary value is paper money.

13. The gaming system of claim 11, wherein the at least one processor causes zero of the displayed plurality of reels to be highlighted for one of the different qualifying wager levels.

14. The gaming system of claim 11, wherein the at least one processor causes at least one of the displayed plurality of reels to be highlighted for each of the different qualifying wager levels.

15. The gaming system of claim 11, wherein the at least one processor causes the at least one display device to display five reels, and the at least one processor provides five different qualifying wager levels.

16. The gaming system of claim 11, wherein the plurality of instructions stored in the at least one memory device provides a different probability associated with each of the greater than two highlighted reels.

17. The gaming system of claim 11, wherein the at least one processor causes the at least on display device to display a wild reel that is animated.

18. The gaming system of claim 11, wherein the plurality of instructions stored in the at least one memory device provides a probability associated with each of the greater than two highlighted reels that is determined based on the correlated qualifying wager level.

19. The gaming system of claim 11, wherein the at least one processor determines at least one of the probability associated with the at least one of the greater than two highlighted reels based at least in part on whether a different one of the greater than two highlighted reels has been determined to be a wild reel.

20. A method for operating a gaming system, the method comprising:

receiving a physical indicia of monetary value via at least one currency acceptor;

validating the receiving of the physical indicia of monetary value;

receiving an electronic communication to begin a new wagering game;

determining a wager associated with the new wagering game;

determining if the associated wager is one of a plurality of qualifying wagers;

when it is determined that the associated wager is one of the plurality of qualifying wagers, determining the level of the qualifying wager;

causing a display device to display five reels;

determining a number of the displayed reels to highlight based on the determined level of the qualifying wager, wherein the number of displayed reels to highlight is greater than one and less than five;

causing a display device to display the spinning of the five reels;

when the number of highlighted reels is equal to one, determining that the highlighted reel is a wild reel;

when the number of highlighted reels is equal to two, determining, based on a probability associated with each of the two highlighted reels, which of the two highlighted reels is a wild reel, wherein the probability associated with each of the two highlighted reels is different;

when the number of highlighted reels is equal to three, determining, based on a probability associated with each of the three highlighted reels, which of the three highlighted reels is a wild reel, wherein the probability associated with each of the three highlighted reels is different;

when the number of highlighted reels is equal to four, determining, based on a probability associated with each of the four highlighted reels, which of the four highlighted reels is a wild reel, wherein the probability associated with each of the four highlighted reels is different;

causing the display device to display any determined wild reel to stop and indicate that the entire reel is wild;

thereafter, causing each of the reels not determined to be a wild reel to stop;

determining the outcome of the game based on the stopped reels; and when the determined outcome is a winning outcome, providing an award to the player based at least in part on the determined outcome and the determined wager.

* * * * *